US005314217A

United States Patent [19]

Place

[11] Patent Number: 5,314,217

[45] Date of Patent: May 24, 1994

[54] BALLOON TYING DEVICE

[76] Inventor: Andrew G. Place, 42 Green Moor Link, Winchmore Hill, London, England, N21 2NP

[21] Appl. No.: 840,846

[22] Filed: Feb. 25, 1992

[30] Foreign Application Priority Data

Feb. 25, 1991 [GB] United Kingdom ..... 9103910
Jul. 2, 1991 [GB] United Kingdom ..... 9114297
Dec. 30, 1991 [GB] United Kingdom ..... 9127489

[51] Int. Cl.[5] ..... D03J 3/00
[52] U.S. Cl. ..... 289/17
[58] Field of Search ..... 289/1.5, 2, 17, 18.1; 446/220, 222

[56] References Cited

U.S. PATENT DOCUMENTS 2,825,592 3/1958 Semple ..... 289/17
2,926,036 2/1960 Wimberley ..... 289/17
3,476,423 11/1969 Kentfield ..... 289/17
3,630,555 12/1971 Newlin ..... 289/17
3,752,516 8/1973 Mumma ..... 289/17
4,510,653 4/1985 Semanko ..... 289/17
4,802,877 2/1989 Davis et al. ..... 289/17
4,864,762 9/1989 Cox ..... 289/17
4,989,906 2/1991 Peverly ..... 289/17
5,039,142 8/1991 Muma ..... 289/17
5,104,160 4/1992 Cheng ..... 289/17

FOREIGN PATENT DOCUMENTS 1321066 6/1973 United Kingdom .
2186905A 8/1987 United Kingdom .

*Primary Examiner*—Clifford D. Crowder
*Assistant Examiner*—Michael A. Neas
*Attorney, Agent, or Firm*—Darby & Darby

[57] ABSTRACT

A balloon tying device comprises an elongate member having a bifurcated end portion defining a slot adapted to receive the neck of a balloon in use. The end portion further comprises outer surfaces about which the neck is wound and has a recess adapted to receive the lips of the balloon to facilitate casting off of the balloon during knotting.

14 Claims, 3 Drawing Sheets

BALLOON TYING DEVICE

This invention relates to a device for tying balloons.

Tying knots in the necks of balloons is a difficult process for many people. Children or other persons who do not have strong or dexterous hands, or people with long fingernails experience particular difficulty in tying balloons. Tying of any quantity for parties etc. can be a tiring and lengthy process.

According to the present invention a balloon tying device comprises an elongate member having a bifurcated end portion defining a slot adapted to receive the neck of a balloon in use, the end portion further comprising outer surfaces about which the neck may be wound in use and a recess adapted to receive the lips of said balloon.

In preferred embodiments of the invention the recess extends longitudinally of the end portion. The recess serves to prevent the lips of the balloon from impeding displacement of the neck thereof from the bifurcated end during formation of the knot. The bifurcated end is preferably tapered to further facilitate displacement of the balloon neck from the device. The bifurcated end may take the form of two arms, the slot being defined between them.

The device conveniently comprises an elongate body formed with said bifurcated end. Preferred embodiments of the invention incorporate an elongate body having two or more differently sized bifurcated ends to accommodate differently sized balloons.

In preferred embodiments of the invention the slot and recess are disposed in inter-communicating relation.

The recess may comprise a widening of the slot on one side of the end portion. One or both of the arms may be cut away to form a recess for the lips of a balloon. The recess is preferably dimensioned so that lips of the balloon received therein do not protrude beyond the outer surfaces in use. The slot may have parallel sides or may taper or be V-shaped to engage the balloon neck.

One or more of the inner surfaces of the slot may be serrated to improve engagement of the neck of the balloon.

A groove or marking may be provided on said outer surfaces to define the path of the balloon in use.

The member may include an aperture extending longitudinally thereof arranged to receive a cord or string for attachment to the balloon.

The member may have parallel inner and outer surfaces or may be U-shaped, V-shaped or C-shaped in cross-section. Manufacture from tubular material is thereby facilitated. A rectangular cross-section may be conveniently employed.

The invention may further comprise a balloon tying arrangement comprising a balloon engaged with a device as previously described.

The invention is further described by means of example but not in any limitative sense, with reference to the accompanying drawings of which:

Figure 1:
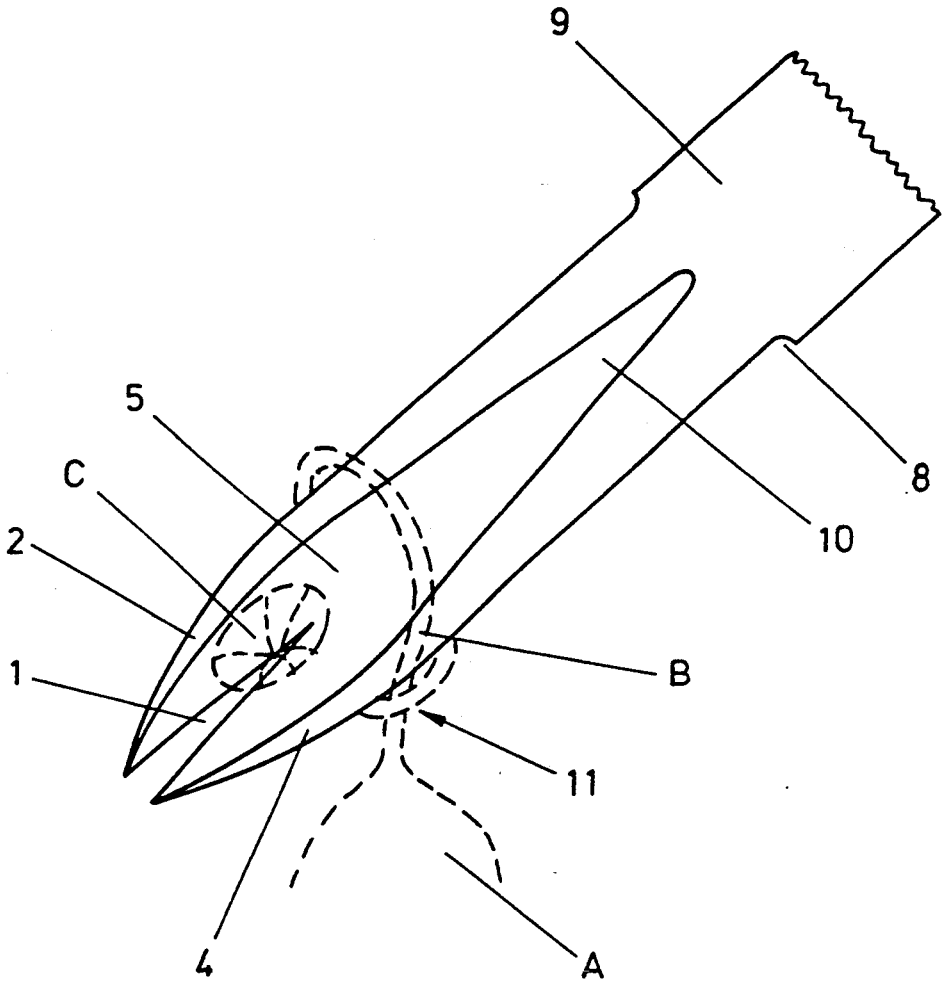
FIG. 1 illustrates a balloon tying device in accordance with this invention.

FIG. 1 illustrates a device in accordance with this invention. An elongate body 9 has a bifurcated end portion 2 defining a slot 1 and outer surfaces 4. A recess 5 formed on one side of the bifurcated end portion 2 is dimensioned to receive the lips C of the neck B of a balloon A. A further longitudinal groove 8 extending along outer surface 4 serves to facilitate engagement of the balloon neck B with a user's finger (not shown) during displacement of the balloon from the device during knotting. In use of the apparatus a balloon A is held with the neck B extended and the neck is wrapped around the outer surfaces 4 of the end portion as shown in FIG. 1. The neck is crossed over itself as shown at 11 and the lips secured within the slot 1 so that they are received within the recess 5. The neck B may then be rolled from the device over the bifurcated members 2 to knot the balloon. In a preferred embodiment of the invention the device may have a dimension of about 15 cm in length and about 1.5 cm in diameter. Alternative dimensions may be employed as convenient. This facilitates convenient manual use with conventional balloons. Alternative embodiments of the invention may have bifurcated portions as shown in FIG. 1 provided at opposite ends of an elongate or otherwise shaped body.

Figure 3:
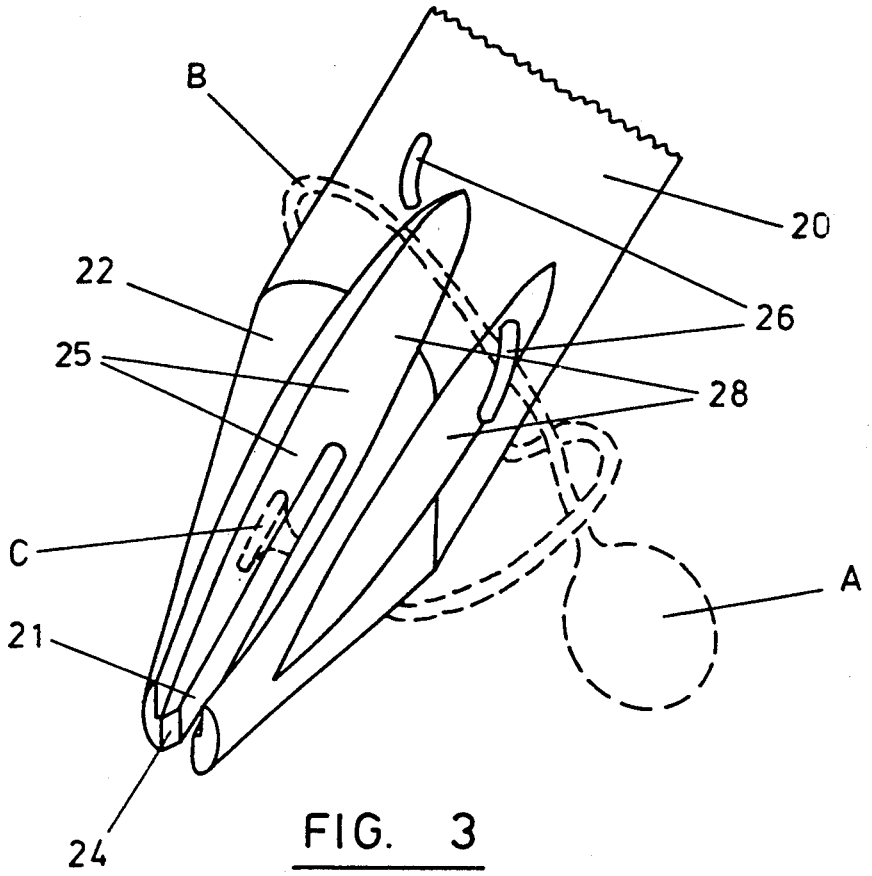
FIG. 3 is a perspective view of an end portion of a further embodiment of the invention.

FIG. 3 illustrates a further embodiment of the invention. The elongate body 20 has a bifurcated end portion 22 defining a slot 21. The terminal surfaces 24 of the sot 21 may be chamfered or otherwise rounded to facilitate insertion of the lips C of a balloon A. Recesses 25 for reception of the lips of the balloon C may be provided on both sides of the bifurcated portion to accommodate left-handed and right-handed users. Grooves 28 may be provided to facilitate removal of the balloon by a user's fingers during the knotting process. One or more pegs or other protrusions 26 may be provided to help hold the neck of the balloon in position during engagement with the knotting device.

Figure 4:
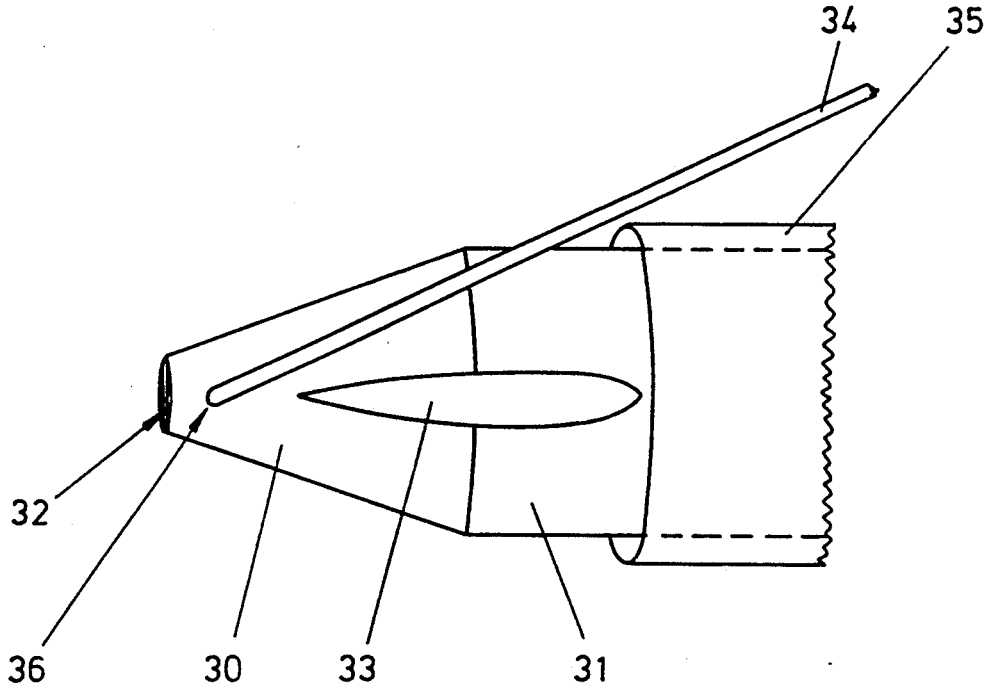
FIG. 4 is a side view of the end portion of a further embodiment of the invention.

FIG. 4 illustrates an alternative embodiment of the invention viewed from the side. The bifurcated portions 30 defining the slot 32 carry a lever 34 pivoted at 36 near to the terminal end of the device. The neck of the balloon is wrapped in use around both the body 31 and lever 34. Actuation of the lever 34 serves to assist in removal of the balloon from the device during the knotting process. In addition or alternatively a sleeve 35 surrounding the end portion 31 may facilitate displacement of the balloon by sliding along the body 31 to urge the balloon from the device.

Figure 5:
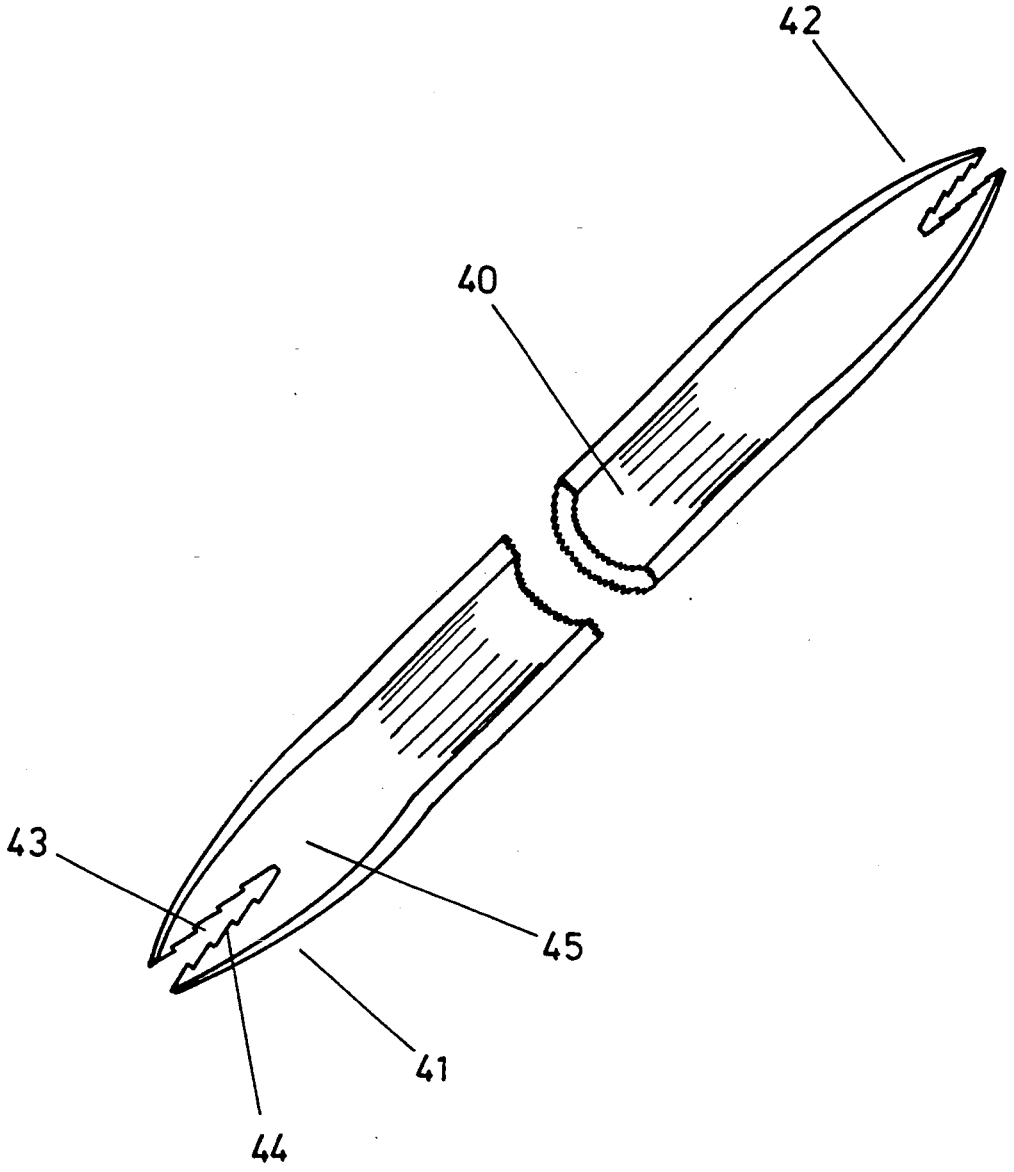
FIG. 5 illustrates the end portion of another embodiment of the invention.

FIG. 5 illustrates a further embodiment of the invention wherein an elongate body formed from a semi-circular or U or C-shaped member has bifurcated end portions 41, 42 defining a slot 43 having serrated edges 44. The end portions 42, 43 are differently sized to accommodate differently sized balloons. The serrated edges 44 serve to securely grasp a balloon with the neck disposed in the recess 45 during the knotting process.

Figure 2:
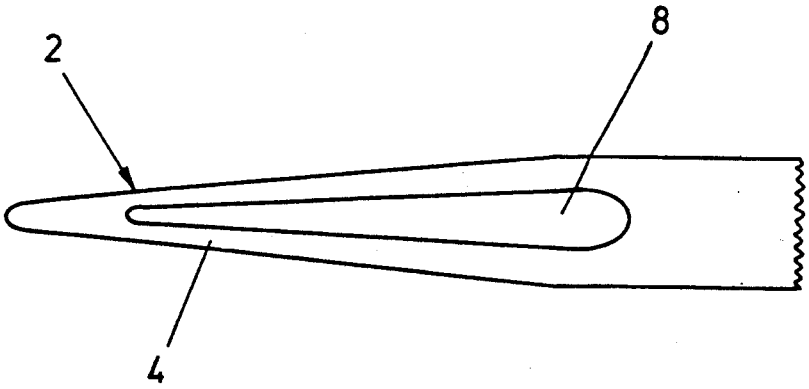
FIG. 2 is a side elevation of the device shown in FIG. 1.

Use of a device in accordance with this invention is described for convenience with reference to FIGS. 1 and 2. The balloon A is inflated and the neck B is wound around the outer portions 4 and looped over itself at 11 so that the lips C can be secured within the slot 1 of the bifurcated portions 2. The lips are preferably received within the recess 5. Deflation of the balloon during winding may be prevented by a user holding the device with his fingers or by securing the neck of the balloon under the peg or pegs 26 as shown in FIG. 3 if the latter embodiment is used. Alternatively the neck of the balloon may be trapped against the device by a user's finger. The neck B of the balloon may be wound once around the device and again tucked under the peg or held in position by a user's finger. The mouth of the balloon C may then be passed over the neck B from behind and inserted into the slot, the lips being disposed within the recess. Alternatively the neck B of the balloon may be held approximately 2 cm from the lips C to prevent escape of air and the neck B wound around the device passing behind the balloon for location within the slot with the lips accommodated within the recess. When the balloon is engaged upon the device, deflation is prevented by tension in the balloon neck. The balloon is self supporting when so engaged. The balloon neck may then be displaced from the end of the device by either rolling the balloon over the end portion, which may be tapered to facilitate this process, or alternatively using the lever or sleeve as shown in FIG. 4 if the latter are provided in the particular embodiment of the invention concerned. A piece of string or a stick may be simply attached to the balloon by passing it through the inner surface of the C-shaped or tubular body portion 40 shown in FIG. 5. The knotted balloon neck is thus formed around the cord or string.

The recess 5 and further slots 8 assist a user's fingers in grasping the balloon during removal from the device.

What I claim is:

1. A balloon tying device comprising an elongate member dimensioned to be held in the hand of a user, the elongate member having a bifurcated end portion which (a) is defined by two arms, and a slot extending between the arms in which slot the neck of a balloon can be received, (b) has outer surfaces about which the neck of the balloon can be wound, and (c) includes a recess formed in the member to receive the lips of the balloon when the neck is received in the slot, the device further comprising a lever which is connected pivotably to the elongate member towards said end portion thereof, so as to be capable of being pivoted away from the member and flared outwardly from the end portion to facilitate displacement of the neck of the balloon which is wound around the end portion.

2. A device as in claim 1, wherein said end portion of the elongate member is tapered.

3. A device as in claim 1, wherein at least said end portion of the elongate member has an open channel-shape when viewed in cross-section.

4. A balloon tying device comprising:

an elongate member dimensioned so as to be held in the hand of a user, said member having a bifurcated end portion including two arms and a slot extending between said arms, the neck of a balloon being receivable in said slot, said end portion including outer surfaces about which the neck of the balloon can be wound and a recess formed in the end portion to receive the lips of the balloon where the neck is received in the slot; and a sleeve surrounding the end portion of the member and slidable along the end portion to displace the neck of a balloon which is wound around the end portion in use of said device.

5. A device as in claim 4, wherein said end portion of the elongate member is tapered.

6. A device as in claim 4, wherein at least said end portion of the elongate member has an open channel-shape when viewed in cross-section.

7. A device as in claim 4, further comprising a lever connected pivotably to said elongate member proximate said bifurcated end portion to be pivoted away from the elongate member so that the device flares outwardly from said bifurcated end to facilitate displacement of the neck of a balloon which is wound around the end portion in use of said device.

8. A device as in claim 4, wherein the inner surfaces of said slot are serrated.

9. A balloon tying device comprising an elongate member which is dimensioned to be held in the hand of a user, the elongate member having a bifurcated end portion which is defined by two arms and a slot extending between the arms, in which slot the neck of the balloon can be received, said elongate member having outer surfaces about which the neck of a balloon can be wound and an open channel-shape when viewed in cross-section at said bifurcated end portion, said channel-shape extending over a length which is greater than the length of the arms, the arms and the channel-shape defining a recess which is open between the arms at said end portion of the device for receiving the lips of the balloon when its neck is received in the slot.

10. A balloon tying device as in claim 9, wherein the device has said open channel-shape, when viewed in cross-section, over substantially its entire length.

11. A device as in claim 9, wherein said end portion of the elongate member is tapered.

12. A device as in claim 9, further comprising a sleeve surrounding said end portion of the elongate member and being slidable along said end portion to displace the neck of a balloon which is wound around the end portion in use of said device.

13. A device as in claim 9, further comprising a lever connected pivotably to said elongate member proximate said bifurcated end portion to be pivoted away from the elongate member so that said device flares outwardly from said bifurcated end to facilitate displacement of the neck of a balloon which is wound around the end portion in use of said device.

14. A device as in claim 9, wherein the inner surfaces of said slot are serrated.

* * * * *